US006669551B2

(12) United States Patent
Kennedy et al.

(10) Patent No.: US 6,669,551 B2
(45) Date of Patent: Dec. 30, 2003

(54) MINE VENTILATION STRUCTURE AND DECK PANELS THEREFOR

(75) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 10/038,356

(22) Filed: Jan. 4, 2002

(65) Prior Publication Data

US 2003/0129937 A1 Jul. 10, 2003

(51) Int. Cl.[7] ..... E21F 1/14
(52) U.S. Cl. ..... 454/169; 405/153
(58) Field of Search ..... 454/169, 170; 405/151, 153, 288; 52/86, 87, 332, 334, 358, 360, 588.1, 630, 713

(56) References Cited

U.S. PATENT DOCUMENTS

| | | | | |
|---|---|---|---|---|
| 3,394,514 A | * | 7/1968 | Lindner | 52/332 |
| 3,555,762 A | * | 1/1971 | Costanzo, Jr. | 52/588.1 |
| 3,812,636 A | * | 5/1974 | Albrecht et al. | 52/334 |
| 4,621,951 A | | 11/1986 | Dewson | |
| 4,630,414 A | | 12/1986 | Ting | |
| 5,165,213 A | * | 11/1992 | Finch et al. | 52/558.1 |
| 5,174,682 A | | 12/1992 | Whitfield | |
| 5,412,916 A | | 5/1995 | Kennedy et al. | |
| 5,466,187 A | | 11/1995 | Kennedy et al. | |
| 5,619,837 A | * | 4/1997 | DiSanto | 52/798.1 |
| 5,879,231 A | | 3/1999 | Sisk | |
| 6,129,483 A | | 10/2000 | Juracko | |
| 6,250,036 B1 | * | 6/2001 | Nurley et al. | 52/537 |
| 6,264,549 B1 | | 7/2001 | Kennedy et al. | |

FOREIGN PATENT DOCUMENTS

| | | |
|---|---|---|
| CA | 1 202 792 | 4/1986 |
| GB | 2 306 526 A | 5/1997 |

OTHER PUBLICATIONS

Steel Deck Institute; SDI Design Manual; Copyright Date: 2000; pp. 8, 30,32 and 35; Publication #30; SDI; Fox River Grove, Illinois.

Jack Kennedy Metal Products & Buildings, Inc., Kennedy Interlocking Overcasts brochure, Nov. 6, 2000.

Carron and Company, Long Span Deck specification sheet, Revised Mar. 4, 1999.

Design Assistance Construction Systems, Inc., Composite Floor Decks web page, available at http://www.dacsinc.com/site.asp?content=inc composite, admitted prior art.

Upright Access Solutions, Spandeck web page, available at http://wwww.go–e.co.uk/upright/spandeck.php, admitted prior art.

Five Photographs of Prior Art Mine Overcasts, admitted prior art.

Search Report from the United Kingdom Patent Office dated May 6, 2003.

* cited by examiner

*Primary Examiner*—Harold Joyce
(74) *Attorney, Agent, or Firm*—Senniger, Powers, Leavitt & Roedel

(57) ABSTRACT

A mine ventilation structure with a deck made up of panels of inverted channel shape modified to be of relatively light weight yet strong.

22 Claims, 3 Drawing Sheets

MINE VENTILATION STRUCTURE AND DECK PANELS THEREFOR

BACKGROUND OF THE INVENTION

This invention relates to mine ventilation structures, such as mine undercasts and mine overcasts of the type shown in U.S. Pat. No. 5,466,187 issued Nov. 14, 1995 to John M. Kennedy and William R. Kennedy, entitled Mine Ventilation Structure, which is incorporated herein by reference.

Reference may be made to said U.S. Pat. No. 5,466,187 for background on mine overcasts (including their function and prior overcast structures), and to the book titled "Practical Mine Ventilation" by William C. Kennedy, published by Intertec Publishing Corporation, for background on mine ventilation structures in general. This book is also incorporated by reference.

SUMMARY OF THE INVENTION

The invention is especially concerned with improvement in the decking of a mine ventilation structure such as the mine overcast disclosed in said U.S. Pat. No. 5,466,187, among the several objects of the invention being noted the provision of a deck made up of panels of relatively lighter weight and of equal or even greater strength for their lighter weight than the panels shown in U.S. Pat. No. 5,466,187, the lighter weight making them more readily transportable; the provision of such a deck which is structurally efficient, having superior beam strength and having a surface characteristic enabling walking thereon; the provision of such a deck with the feature of interconnection of the panels for transfer of weight from one panel to an adjacent panel or panels; the provision of such a deck with the feature of panel edge support; and the provision of an improved panel for use in making the aforementioned deck.

In general, a mine ventilation structure of this invention comprises a deck which includes a plurality of elongate sheet metal panels, each panel being generally of modified inverted channel shape in transverse cross-section having a web at the top and side flanges extending down vertically from opposite sides of the web. The web is modified so as to have a flat horizontal area and an indentation extending down from the flat area between the side flanges lengthwise of the panel. The panels extend in side-by-side relation with the flanges of adjacent panels substantially contiguous one with another and the flat horizontal areas of the panels in generally coplanar relation forming a walking surface. The indentation in each panel is of such depth that the neutral axis of the panel is in the lower two-thirds of the panel depth.

The present invention is also directed to a plurality of elongate deck panels of the type described above for use in constructing a mine ventilation structure, such as a mine overcast or undercast.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
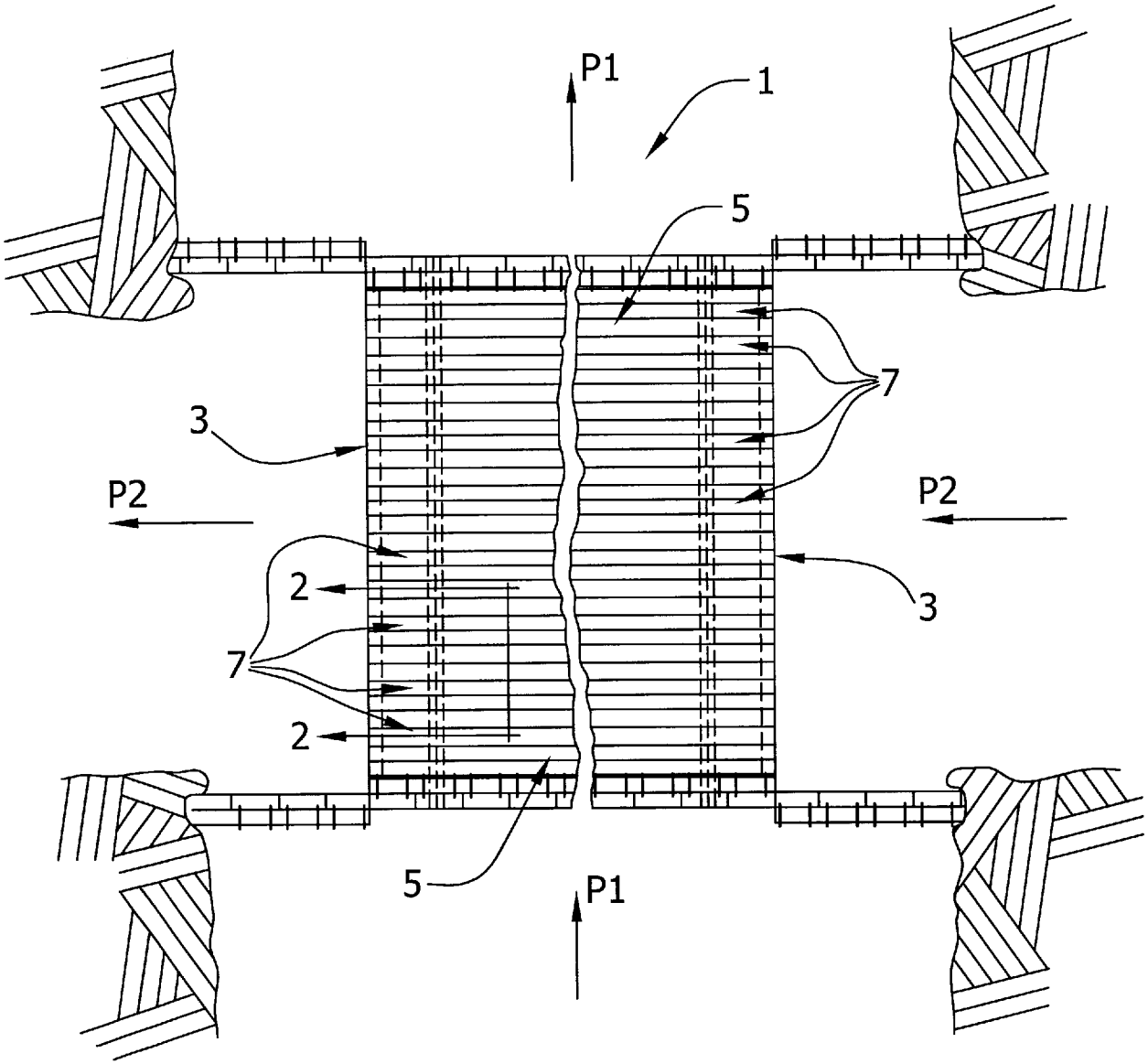
FIG. 1 is a top plan of an overcast structure of the invention, parts being broken away.
Figure 2:
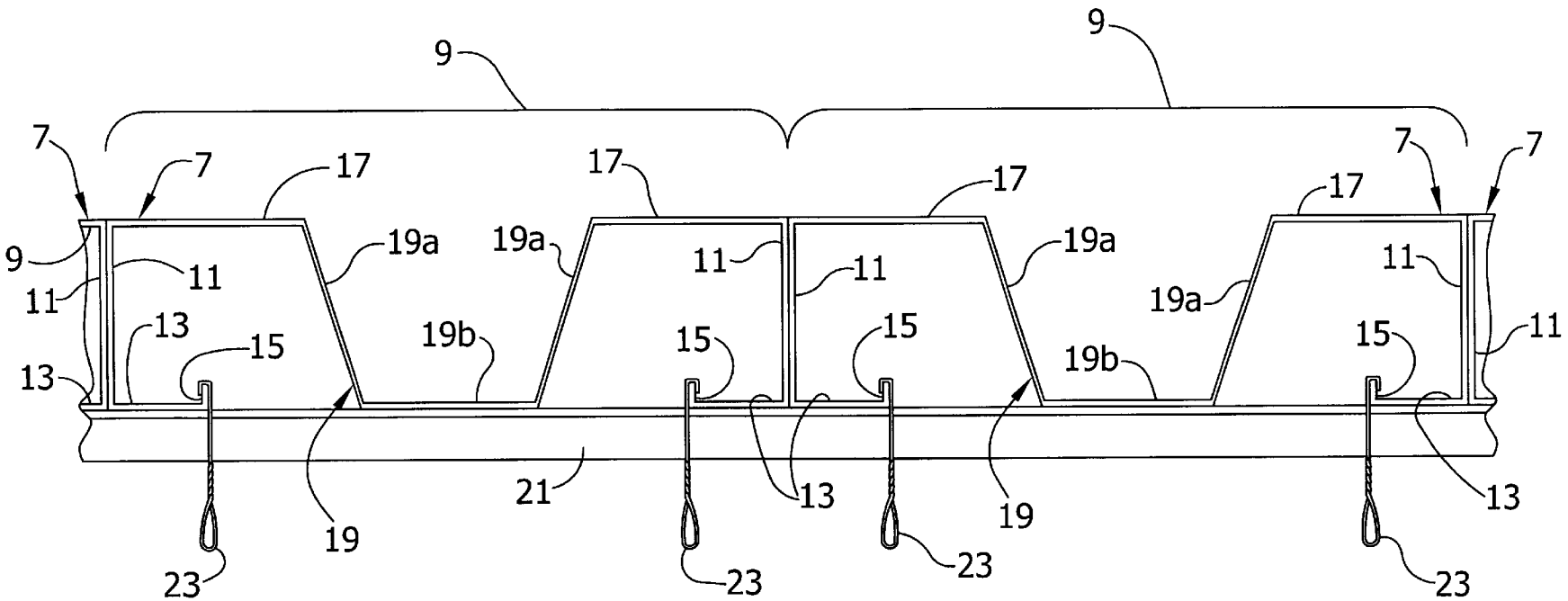
FIG. 2 is a vertical section taken generally on line 2—2 of FIG. 1 on a larger scale than FIG. 1.

Referring first to FIG. 1 of the drawings, a mine overcast of this invention, designated in its entirety by the reference numeral 1, is shown to comprise a tunnel-forming structure having generally parallel spaced-apart side walls each designated 3 and a deck designated in its entirety by the reference numeral 5 spanning the side walls constituting the roof of the tunnel and the floor of a passage over the tunnel. The overcast is installed at the intersection of two passageways P1, P2 in a mine to maintain the air flowing through the two passageways separate. (In the embodiment shown in FIG. 1, the airflow in passageway P1 passes through the overcast 1 and the airflow in passageway P2 passes over the overcast.)

Figure 4:
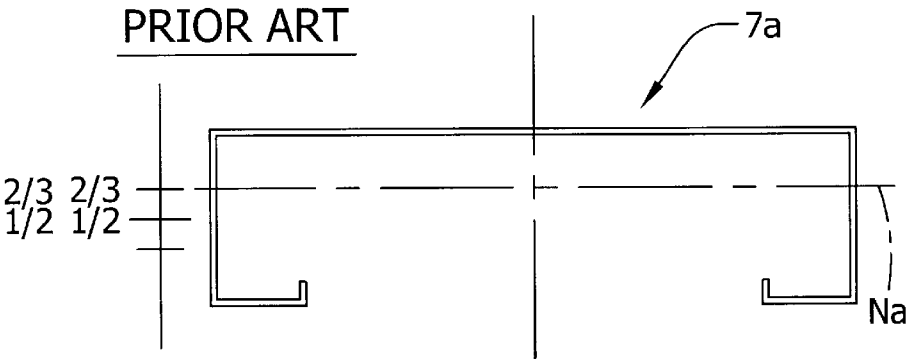
FIG. 4 PRIOR ART
FIG. 4 is a view like FIG. 3 illustrating a deck panel such as shown in U.S. Pat. No. 5,466,187 with the neutral axis thereof shown in phantom, for comparison with FIG. 3.
Figure 3:
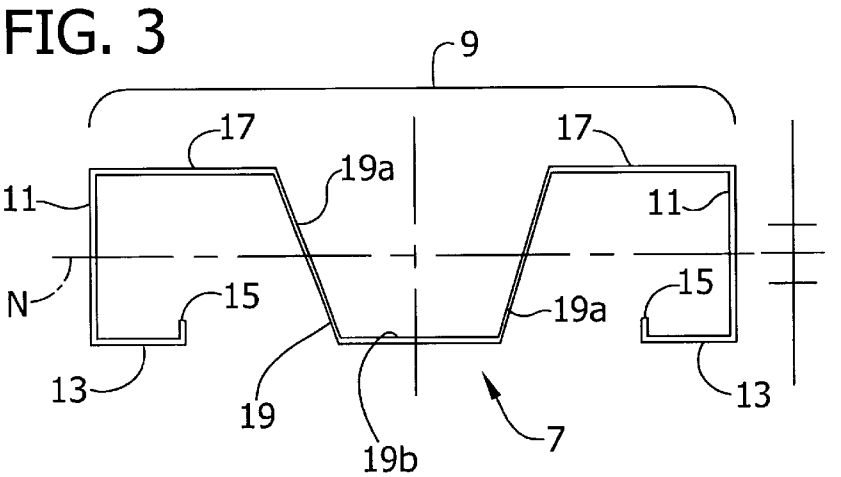
FIG. 3 is an enlarged fragment of FIG. 2 showing one of the deck panels in transverse section with the neutral axis of the panel indicated in phantom.

The deck 5 of the overcast 1 comprises a plurality of elongate sheet metal panels 7 (eight being shown by way of example) extending between (bridging) the side walls 3. To this extent, the overcast corresponds to that disclosed in U.S. Pat. No. 5,466,187 and reference may be made thereto for detail, but it differs therefrom in that each panel 7 (preferably made of sheet metal) is modified with respect to the cross-section of each panel making up the deck of U.S. Pat. No. 5,466,187 (one of which is illustrated in FIG. 4 side-by-side with FIG. 3 for comparison).

Thus, each panel 7 is generally of modified inverted channel shape in transverse cross-section, having a web 9 at the top and flanges 11 extending down vertically from opposite sides of the web, the flanges having inwardly turned lips 13 with upturned free edges 15. The web 9 is modified with respect to the web of the panel of U.S. Pat. No. 5,466,187 so as to have side portions 17 presenting a generally flat horizontal area and an indentation, generally designated 19, extending down from the flat area between the side walls lengthwise of the panel 7 (i.e. between side portions 17). The panels 7 extend between the tunnel side walls 3 in side-by-side relation with the flanges 11 of adjacent panels substantially contiguous one with another and the flat horizontal areas presented by web side portions 17 in generally coplanar relation forming a walking surface. Tie bars 21 and wire ties 23 may be used as in U.S. Pat. No. 5,466,187 to secure the panels 7 in place. The indentation 19 in each panel 7 is of such depth D that the neutral axis N (see FIG. 3) of the panel 7 is preferably in the lower two-thirds of the panel depth D (the width of each of flanges 11, which is the depth of each flange in the horizontal disposition of the panel). In the particular embodiment shown in FIG. 3 the neutral axis N is at approximately the one-half panel depth level. Thus, the neutral axis N is lower than the neutral axis Na of the panel 7*a* of U.S. Pat. No. 5,466,187 (compare FIGS. 3 and 4). This is brought about by the indenting of the web 9 bringing sheet metal down from the web as shown.

Bringing the neutral axis N down as above noted enables reduction in the gauge of the sheet metal making up a panel 7 and thus a reduction in the weight of the panel without detracting from the strength of the panel acting as a beam. The strength is a function of the section modulus which is defined by the moment of inertia of the cross-sectional area divided by the greatest distance from an "extreme fiber" to the neutral axis. Thus, by bringing the neutral axis N down to the level shown, the distance from the lips 13 (formerly the "extreme fiber") to the neutral axis is lessened and the moment of inertia divided by this smaller distance (the section modulus) is increased.

The decrease in the gauge of the sheet metal used is more than enough to offset the increase in cross-sectional area of a panel 7 brought about by the indentation 19. For example, panel 7 may be made of 14 gauge (0.079 in.) sheet steel with a cross-sectional area of 4.144 $in^2$ and with a section modulus of 7.726 $in^3$, as contrasted with a U.S. Pat. No. 5,466,187 panel 7*a* of 14 gauge (0.079 in.) sheet steel with a cross-sectional area of 3.503 $in^2$ having a section modulus of 5.39 $in^3$. Thus panel 7 is significantly stronger than the prior design, which permits the panel to be made of lighter gauge material with attendant reduction in material cost. Using one calculation, for example, a panel 7 of the present invention made of sheet steel having a thickness of 0.055 in. and a cross sectional area of 2.884 $in^2$ would have about the same section modulus (5.399 $in^3$) as the prior panel 7*a* described above, yet it would use only about 82% (2.884/3.503) of the material.

The indentation 19 is generally for the full depth of panel 7. Preferably, it is generally V-shaped with inclined side walls 19*a* and a flat bottom 19*b* generally in the horizontal plane of the lower edges of flanges 11 (i.e. of lips 13). However, it will be understood that the indentation can have other suitable shapes (e.g., U) without departing from the scope of this invention.

The improved deck panels of this invention can be used to construct other types of mine structures, such as mine undercasts, bridge crossings (sometimes referred to as "bridgecasts"), and belt crossings.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A mine ventilation structure comprising a deck including a plurality of elongate sheet metal panels, each panel being generally of modified inverted channel shape in transverse cross-section having a web at the top and side flanges extending down from opposite sides of the web, said web being modified so as to have a flat generally horizontal area and an indentation extending down from the flat area between the side flanges lengthwise of the panel, the panels extending in side-by-side relation with the flanges of adjacent panels substantially contiguous one with another and the flat horizontal areas of the panels in generally coplanar relation forming a walking surface, the indentation in each panel being of such depth that the neutral axis of the panel is in the lower two-thirds of the panel depth.

2. A mine ventilation structure as set forth in claim 1 wherein the neutral axis is at approximately the one-half panel depth level.

3. A mine ventilation structure as set forth in claim 1 wherein the indentation is generally for the full panel depth.

4. A mine ventilation structure as set forth in claim 1 wherein the indentation is generally V-shaped.

5. A mine ventilation structure as set forth in claim 4 wherein the generally V-shaped indentation has a flat bottom generally in the plane of the lower edges of the flanges.

6. A mine ventilation structure as set forth in claim 1 wherein said mine ventilation structure is a mine overcast having generally parallel spaced-apart side walls, said deck spanning the side walls.

7. A mine ventilation structure as set forth in claim 3 wherein the web of each panel has only one said indentation which extends generally for the full panel depth.

8. A mine ventilation structure as set forth in claim 7 wherein the indentation is generally V-shaped.

9. A mine ventilation structure as set forth in claim 7 wherein a top surface of the deck is generally free of any other material such that the flat areas form the walking surface.

10. A mine ventilation structure as set forth in claim 1 wherein the indentation has a width substantially less than the flat horizontal area and wherein the gap between webs of adjacent panels s minimal so as to maximize the walking surface.

11. A plurality of elongate sheet metal deck panels for use in constructing a mine ventilation structure, each panel being generally of modified inverted channel shape in transverse cross-section having a web at the top and side flanges extending down from opposite sides if the web, said web being modified so as to have a flat horizontal area and an indentation extending down from the flat area between the side flanges lengthwise of the panel, the deck panels being adapted to extend in side-by-side relation with the flanges of adjacent panels substantially contiguous one with another and the flat horizontal areas of the panels in generally coplanar relation forming a walking surface, the indentation in each deck panel being of such depth that the neutral axis of the panel is in the lower two-thirds of the panel depth.

12. A plurality of elongate sheet metal deck panels as set forth in claim 11 wherein the neutral axis is at approximately the one-half panel depth level.

13. A plurality of elongate sheet metal deck panels as set forth in claim 11 wherein the indentation is generally for the full panel depth.

14. A plurality of elongate sheet metal deck panels as set forth in claim 11 wherein the indentation is generally v-shaped.

15. A plurality of elongate sheet metal deck panels as set forth in claim 14 wherein the generally V-shaped indentation has a flat bottom generally in the plane of the lower edges of the flanges.

16. A plurality of elongate sheet metal deck panels as set forth in claim 9 wherein the web of each panel has only one said indentation which extends generally for the full panel depth.

17. A plurality of elongate sheet metal deck panels as set forth in claim 16 wherein the indentation is generally V-shaped.

18. A plurality of elongate sheet metal deck panels as set forth in claim 16 wherein the indentation has a width substantially less than the flat horizontal area and wherein the gap between webs of adjacent panels is minimal so as to maximize the walking surface.

19. A mine ventilation structure installed at the intersection of two mine passageways, the structure comprising:

parallel spaced-apart side walls, a plurality of tie bars and spanning the side walls and connected thereto;

a deck including a plurality of elongate sheet metal panels spanning the side walls over the tie bars; each panel being generally of modified inverted channel shape in transverse cross-section having a web at the top and side flanges extending down vertically from opposite sides of the web, the flanges having lips and free edges; and ties securing the flanges to the tie bars;

said web being modified so as to have a flat generally horizontal area and an indentation extending down from the flat area between the side flanges lengthwise of the panel, the panels extending in side-by-side relation with the vertical flanges of adjacent panels in substantial contact one with another and the flat horizontal areas of the panels in generally coplanar relation and in substantial contact one with another to form a walking surface generally free of any overlying material, and the indentation in each panel being of such depth that the neutral axis of the panel is in the lower two-thirds of the panel depth.

20. A mine ventilation structure as set forth in claim 19 wherein the web of each panel has only one said indentation which extends generally for the full panel depth.

21. A mine ventilation structure as set forth in claim 20 wherein the indentation is generally V-shaped.

22. A mine ventilation structure as set forth in claim 19 wherein the lips of each panel are inwardly turned from the flanges.

* * * * *

UNITED STATES PATENT AND TRADEMARK OFFICE

CERTIFICATE OF CORRECTION

PATENT NO. : 6,669,551 B2
DATED : December 30, 2003
INVENTOR(S) : William R. Kennedy et al.

It is certified that error appears in the above-identified patent and that said Letters Patent is hereby corrected as shown below:

Column 4,
Line 16, "panels s minimal" should read -- panels is minimal --.

Signed and Sealed this

Eleventh Day of May, 2004

JON W. DUDAS
*Acting Director of the United States Patent and Trademark Office*